US006657844B2

(12) United States Patent
Iwazaki

(10) Patent No.: US 6,657,844 B2
(45) Date of Patent: Dec. 2, 2003

(54) ELECTROMAGNETIC DRIVE CONTROL DEVICE

(75) Inventor: Shoji Iwazaki, Tokyo (JP)

(73) Assignee: Pentax Corporation, Tokyo (JP)

( * ) Notice: Subject to any disclaimer, the term of this patent is extended or adjusted under 35 U.S.C. 154(b) by 72 days.

(21) Appl. No.: 10/011,413

(22) Filed: Dec. 11, 2001

(65) Prior Publication Data

US 2002/0075109 A1 Jun. 20, 2002

(30) Foreign Application Priority Data

Dec. 14, 2000 (JP) ..... 2000-379803

(51) Int. Cl.[7] ..... H01H 47/00
(52) U.S. Cl. ..... 361/152; 361/154; 361/159
(58) Field of Search ..... 361/152, 154, 361/159, 160

(56) References Cited

U.S. PATENT DOCUMENTS 4,357,645 A * 11/1982 Lilienthal ..... 361/93.1
4,495,536 A * 1/1985 Bynum ..... 361/58
5,424,897 A * 6/1995 Mietus et al. ..... 361/92
5,519,295 A * 5/1996 Jatnieks ..... 318/453
5,764,053 A * 6/1998 Robbins et al. ..... 324/226

* cited by examiner

*Primary Examiner*—Anthony Dinkins
(74) *Attorney, Agent, or Firm*—Greenblum & Bernstein, P.L.C.

(57) ABSTRACT

A drive control circuit for an electromagnetic driving device includes a magnet and a drive coil, which moves due to an electromagnetic force when an electrical current flows therethrough. The drive control circuit may include (1) a drive circuit that feeds an electrical current to the drive coil, the drive circuit including at least one voltage source, and (2) a short-circuit system that short-circuits the drive coil. The short-circuit system releases the short-circuited condition of the drive coil in accordance with an output voltage of the at least one voltage source.

13 Claims, 8 Drawing Sheets

+Vcc
+VT
OPout
0v
t
-VT
-Vcc

ID
t

ON
OFF
t

ON
OFF
t

Ic
0
t

+Vcc
0v
-Vcc
OPout
ΔVT(=VZ)
t

ID
t

ON
OFF
t

ON
OFF
t

Ic
0
t

ELECTROMAGNETIC DRIVE CONTROL DEVICE

BACKGROUND OF THE INVENTION

The present invention relates to an electromagnetic drive control device for controlling electromagnetic driving devices which are employed in various instruments as a drive source.

An electromagnetic driving device typically drives an actuator making use of an electromagnetic force generated between a permanent magnet and a coil in which an electrical current flows. The driving force can be controlled by controlling the current flowing through the coil. Since the electromagnetic driving device can be made relatively compact in size, it is widely employed, as a driving source, for an objective lens driving device of a camera, a scanning position compensating device for a laser scanning device, a driving device for a linear motor car, and the like.

As an example, the scanning position compensating device will be described. In the scanning position compensating device for a laser scanning device, a driving coil is swingably (rotatably) supported in a magnetic field generated by a magnet which is secured to the electromagnetic driving device. As the electrical current is fed to the driving coil, it swings due to the electromagnetic force. The driving coil typically supports a prism, which swings with respect to the optical axis as the driving coil swings, thereby deflecting a passage of the laser beam. In this type of drive control device for controlling the electromagnetic drive that controls the direction of the electrical current flowing through the coil, a circuit as shown in FIG. 9 is generally employed.

The circuit shown in FIG. 9 includes a drive circuit 41, which includes an operational amplifier OP, a resistor R, and a current buffer circuit 411. The current buffer circuit 411 is configured such that an NPN transistor TR1 and a PNP transistor TR2 are connected in accordance with a complimentary emitter follower connection. The drive circuit 41 is a so-called voltage-current conversion circuit, which outputs an electrical current in accordance with a voltage of an input drive control signal CS to a drive circuit 30.

In such a voltage-current conversion type drive control circuit, the output current I is grounded through a drive coil 24 and the resistor R. The drive circuit 41 operates such that the voltage R*I equals the drive control signal CS. When the drive control signal CS is positive, a positive voltage +Vcc is applied to an terminal A of the drive coil 24, and thus, the current flows from the terminal A to a terminal B. When the drive control signal CS is negative, a negative voltage −Vcc is applied to the terminal A, thereby the electrical current flowing from the terminal B to the terminal A. As the direction of the electrical current flowing through the drive coil 24 switches as described above, the direction of the electromagnetic force caused between the drive coil 24 and the magnet 223 switches. Thus, the drive coil 24 can be driven to operate as desired. Further, depending on the voltage of the drive control signal CS, the voltage output by the drive circuit 41 varies. Then, the current flowing through the drive coil 24 varies, and the electromagnetic force between the drive coil 24 and the magnet 223 varies. Accordingly, by controlling the voltage of the drive control signal CS, the amount of the swing movement of the drive coil 24 can be controlled.

In the conventional drive control circuit as described above, when power sources (i.e., +Vcc and −Vcc) are turned from ON to OFF and the voltages change from 0V to designated values (+Vcc and −Vcc), one of the power sources may reach the designated voltage earlier than the other. In such a case, the performance of the circuit may become unstable. In a particular case, the output of the operational amplifier OP is fixed, for example, to +Vcc or −Vcc. In such a case, a maximum (or minimum) drive current is output from the drive circuit 41 to the drive coil 24. Then, an electrical damage and/or a mechanical damage of the electromagnetic drive device will be caused.

Further to the above, when the power sources are in OFF condition, the following problem may occur. When the power sources are in OFF condition, no electrical current flows through the coil 24. Since the drive coil 24 is in an electrically open status, no electromagnetic force is generated between the drive coil 24 and the magnet 223 when the power sources are in the OFF condition. If an oscillation or a shock is applied from outside to the drive coil 24 under such a condition, the drive coil 24 may be swung greatly exceeding a limited movable range. In such a case, thin feed lines connected to the drive coil 24 may be cut, or a supporting mechanism for the drive coil 24 may be mechanically damaged.

As described above, the conventional drive control device provided with two power sources has defects.

It should be noted that a drive control device employing a single power source also has a similar problem, if a relatively long time is required till the voltage of the power source reaches the designated value after turning ON the power source. In such a case, the maximum current may flow through the drive coil and the electromagnetic drive device may be electrically damaged when the power source is turned ON. Further, since the coil is in the unstable condition when the power source is in the OFF condition, the electromagnetic drive device may be mechanically damaged due to the external oscillation or shock.

As explained above, in the conventional electromagnetic drive control device, the operation of the electromagnetic driving device may be unstable, and the life thereof may be relatively short.

SUMMARY OF THE INVENTION

In view of the above problems, it is an object of the present invention to provide an improved electromagnetic drive control device for an electromagnetic driving device, in which the above-described problems when the power sources are turned ON and/or when the power sources are in the OFF condition are resolved.

For the above object, according to the invention there is provided a drive control circuit for an electromagnetic driving device including a magnet and a drive coil that moves due to an electromagnetic force, when an electrical current flows therethrough. The drive control circuit may include a drive circuit that feeds an electrical current to the drive coil, the drive circuit including at least one voltage source, a short-circuit system that short-circuits the drive coil, the short-circuit system releasing the short-circuited condition of the drive coil in accordance with an output voltage of the at least one voltage source.

With this configuration, when the voltage source is in the OFF condition, since the drive coil is short-circuited, a counter electromotive force is generated when the external shock or oscillation is applied, which prevents the excessive movement of the drive coil. Further, when the voltage source is turned ON, the output current of the drive control circuit will be or will not be fed to the drive coil depending on the output voltage of the voltage source. Thus, the above-described problem of the overcurrent across the drive coil can be prevented.

Optionally, the short-circuit system may include a voltage detection circuit that detects the output voltage of the at least one voltage source.

Still optionally, the short-circuit system may include an electromagnetic relay system, which is provided with a magnet coil actuated in accordance with an output of the voltage detection circuit, a contact switch provided between both end terminals of the drive coil, the contact switch neutrally connecting the both end terminals of the drive coil, the contact switch disconnecting the both end terminals of the drive coil when the magnet coil is actuated.

Further optionally, the voltage detection circuit may include a switching circuit connected between the at least one voltage source and the magnet coil, the switching circuit being turned ON to connect the at least one voltage source and the magnetic coil when the output of the voltage source has satisfied a predetermined condition.

Still optionally, the drive circuit may have an input terminal to which a control signal is input, the drive circuit outputting an electrical current to the drive coil through the short-circuit system.

In a particular case, the at least one voltage source includes a positive voltage source and a negative voltage source. In this case, the short-circuit system may include a first voltage detection circuit that detects the output voltage of the positive voltage source and a second voltage detection circuit that detects the output voltage of the negative voltage source, and the short-circuit system may maintain or release the short-circuited condition of the drive coil in accordance with the output voltages of the positive and negative voltage sources.

According to one embodiment, the short-circuit system releases the short-circuited condition of the drive coil when the absolute values of the output voltages of the positive and negative voltage sources exceed predetermined values, respectively.

In this case, the short-circuit system may include an electromagnetic relay system which is provided with a magnet coil, a contact switch provided between both end terminals of the drive coil, the contact switch neutrally connecting the both end terminals of the drive coil, the contact switch disconnecting the both end terminals of the drive coil when the magnet coil is actuated. The voltage detection circuit may include a first switching circuit connected between the positive voltage source and the one end of the magnet coil and a second switching circuit connected between the negative voltage source and the other end of the magnet coil, the first and second switching circuits being turned ON when the absolute values of the output voltages of the positive and negative voltage sources exceed the predetermined values, respectively.

According to another embodiment, the short-circuit system releases the short-circuited condition of the drive coil when a difference between the output voltages of the positive and negative voltage sources exceeds a predetermined value.

In this case, the short-circuit system includes an electromagnetic relay system which is provided with a magnet coil, a contact switch provided between both end terminals of the drive coil, the contact switch neutrally connecting the both end terminals of the drive coil, the contact switch disconnecting the both end terminals of the drive coil when the magnet coil is actuated. The voltage detection circuit may include a first switching circuit connected between the positive voltage source and the one end of the magnet coil and a second switching circuit connected between the negative voltage source and the other end of the magnet coil, the first and second switching circuits being turned ON when the difference between the output voltages of the positive and negative voltage sources exceeds the predetermined value.

According to a further embodiment, the at least one voltage source includes a single voltage source, the short-circuit system includes a single voltage detection circuit that detects the output of the single voltage source, and the short-circuit system maintains or releases the short-circuited condition of the drive coil in accordance with the output voltages of the single voltage sources.

In this case, the short-circuit system releases the short-circuited condition of the drive coil when the output voltages of the single voltage sources exceed a predetermined value.

Further, the short-circuit system includes an electromagnetic relay system is provided with a magnet coil, a contact switch provided between both end terminals of the drive coil, the contact switch neutrally connecting the both end terminals of the drive coil, the contact switch disconnecting the both end terminals of the drive coil when the magnet coil is actuated, and the voltage detection circuit includes a single switching circuit connected between the single voltage source and one end of the magnet coil, the switching circuit being turned ON when the output voltages of the single voltage sources exceeds the predetermined value.

BRIEF DESCRIPTION OF THE ACCOMPANYING DRAWINGS

FIG. 1 schematically shows a configuration of a laser beam printer, which employs an electromagnetic driving device according to an embodiment of the invention;

DESCRIPTION OF THE EMBODIMENT

Hereinafter, an embodiment and its modifications will be described with reference to the accompanying drawings.

Figure 1:
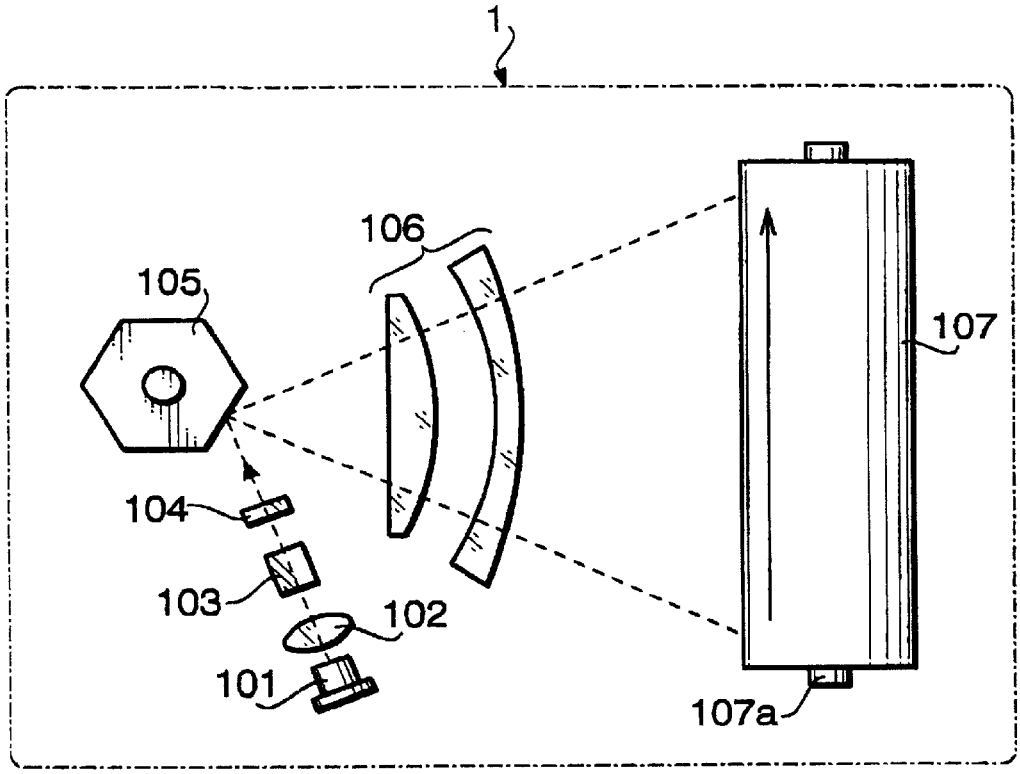

FIG. 1 schematically shows a configuration of a laser beam printer 1, which employs an electromagnetic driving device according to an embodiment of the invention. The laser beam printer 1 includes a laser diode 101, a collimating lens 102, an optical axis adjusting device 103, a cylindrical lens 104, a polygonal mirror 105, and fθ lens 106 and a photoconductive drum 107.

A laser beam LB emitted by the laser diode 101 is collimated by the collimating lens 102. The collimated laser beam LB is incident on the optical axis adjusting device 103, by which the position of the optical axis is adjusted (i.e., the passage of the laser beam is adjusted). The beam LB passed through the optical axis adjusting device 103 is incident on the cylindrical lens 104, and the cross sectional shape of the beam is changed to a circular shape. Then, the thus shaped laser beam LB is incident on the polygonal mirror 105, which rotates at a high speed. The incident laser beam LB is reflected by the reflective side surfaces of the polygonal mirror 105 so that the laser beam LB scans within a predetermined angular range in a main scanning direction. The scanning beam LB passes through the fθ lens 106, and is incident on the photoconductive surface 107*a* of the photoconductive drum 107. The photoconductive drum 107 is arranged such that a beam spot formed by the incident laser beam LB moves in a direction parallel to the rotational axis of the photoconductive drum 107 (a main scanning is performed). While the main scanning movement of the beam spot occurs, the photoconductive drum 107 rotates about the rotational axis (i.e., an auxiliary scanning is performed), so that the circumferential surface of the photoconductive drum 107 is scanned with the laser beam LB.

Figure 2:
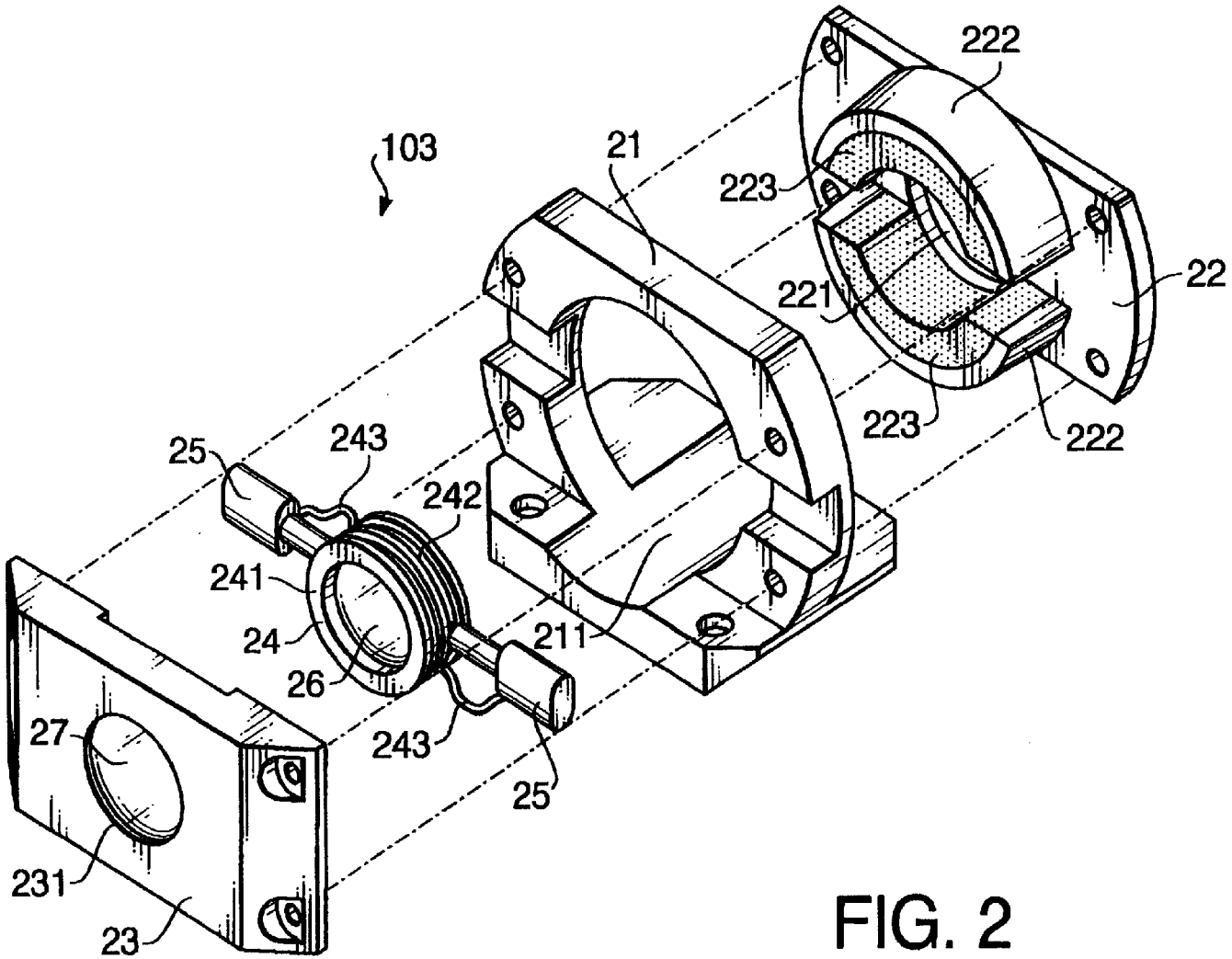
FIG. 2 is an exploded perspective view of an optical axis adjusting device provided with the electromagnetic driving device.
Figure 3:
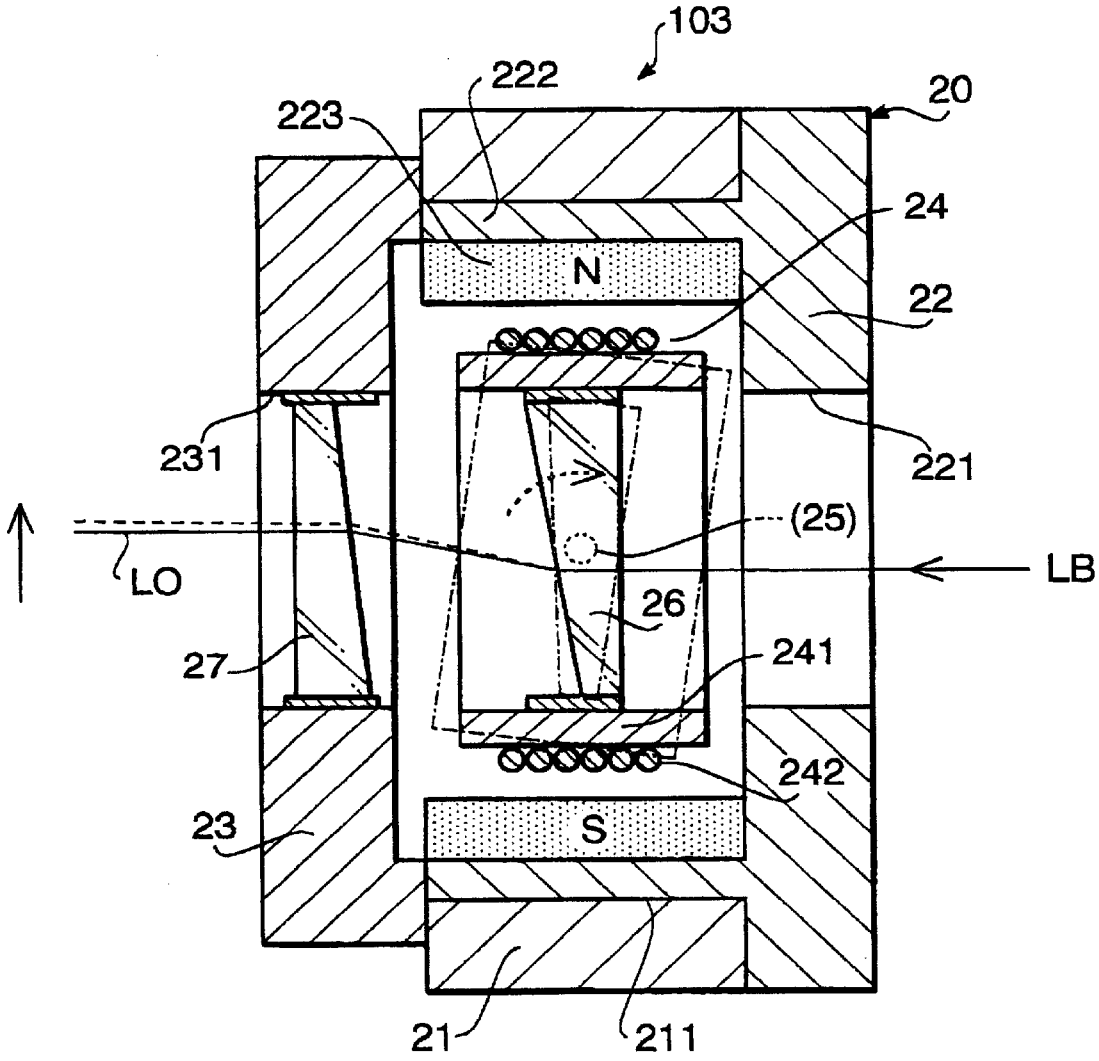
FIG. 3 is a cross sectional view of the optical axis adjusting device taken along the optical axis.

In this embodiment, the optical axis adjusting device 103 includes an electromagnetic driving device. FIG. 2 is an exploded perspective view of the optical axis adjusting device 103. FIG. 3 is a cross sectional view of the optical axis adjusting device 103 taken along the optical axis.

The optical axis adjusting device 103 has a casing 20, which includes a base 21 formed with a circular opening 211, a yoke 22 to be secured on the rear side of the base 21, and a cover 23 to be secured on the front side of the base 21. On the yoke 22, a pair of semicylindrical protrusions 222 are formed opposed to each other. The circumferential surfaces of the pair of semicylindrical protrusions 222 are formed to fit in the circular opening 211 of the base 21. On inner surfaces of the semicylindrical protrusions 222, semicylindrical magnets 223 are provided. Further, on the yoke 22, a circular window 221 is defined. Between the magnets 223, a cylindrical drive coil 24 is arranged such that the central axis of the drive coil 24 coincides with the central axis of the circular window 221.

The drive coil 24 is provided with a pair of horizontally extending swing arms 25, which are held by the base 21. With this configuration, the drive coil 24 is swingable, within a predetermined angular range, about the swing arms 25. The drive coil 24 is formed by winding a line 242 around a cylindrical bobbin 241, both ends of the line 242 being connected to flexible feed lines 243, respectively.

The bobbin 241 holds a movable prism 26 having an inclined surface such that the inclined surface is perpendicular to the optical axis.

The cover 23 is formed with a circular window 231 the central axis of which coinciding with that of the circular opening 211. In the circular window 231, a prism 27 having an inclined surface, which is similar to the prism 26, is fixed such that the inclined surface is oriented in an opposite direction with respect to the movable prism 26 (see FIG. 3).

The magnets 223 and the drive coil 24 constitute an electromagnetic device 30. As an electrical current flows through the coil 24 via the feed lines 243, due to interaction between magnetic fields generated by the magnets 223 and generated by the coil 24, the coil 24 rotates about the swing arms 25. The swinging amount (i.e., the swinging angle with respect to its neutral position) is determined by the amount of the electrical current flowing through the coil 24.

As shown in FIG. 3, when the coil 24 swings, the movable prism 26 inclines with respect to the optical axis LO as indicated by dotted lines. Then, the position of the laser beam LB output from the optical axis adjusting device 103 is shifted in an up-down direction in FIG. 3. The shifting amounts of the output laser beam LB is determined by the swinging angle of the coil 24. Therefore, by controlling the swinging angle of the drive coil 24, the optical axis adjustment of the laser beam LB can be performed.

Figure 4:
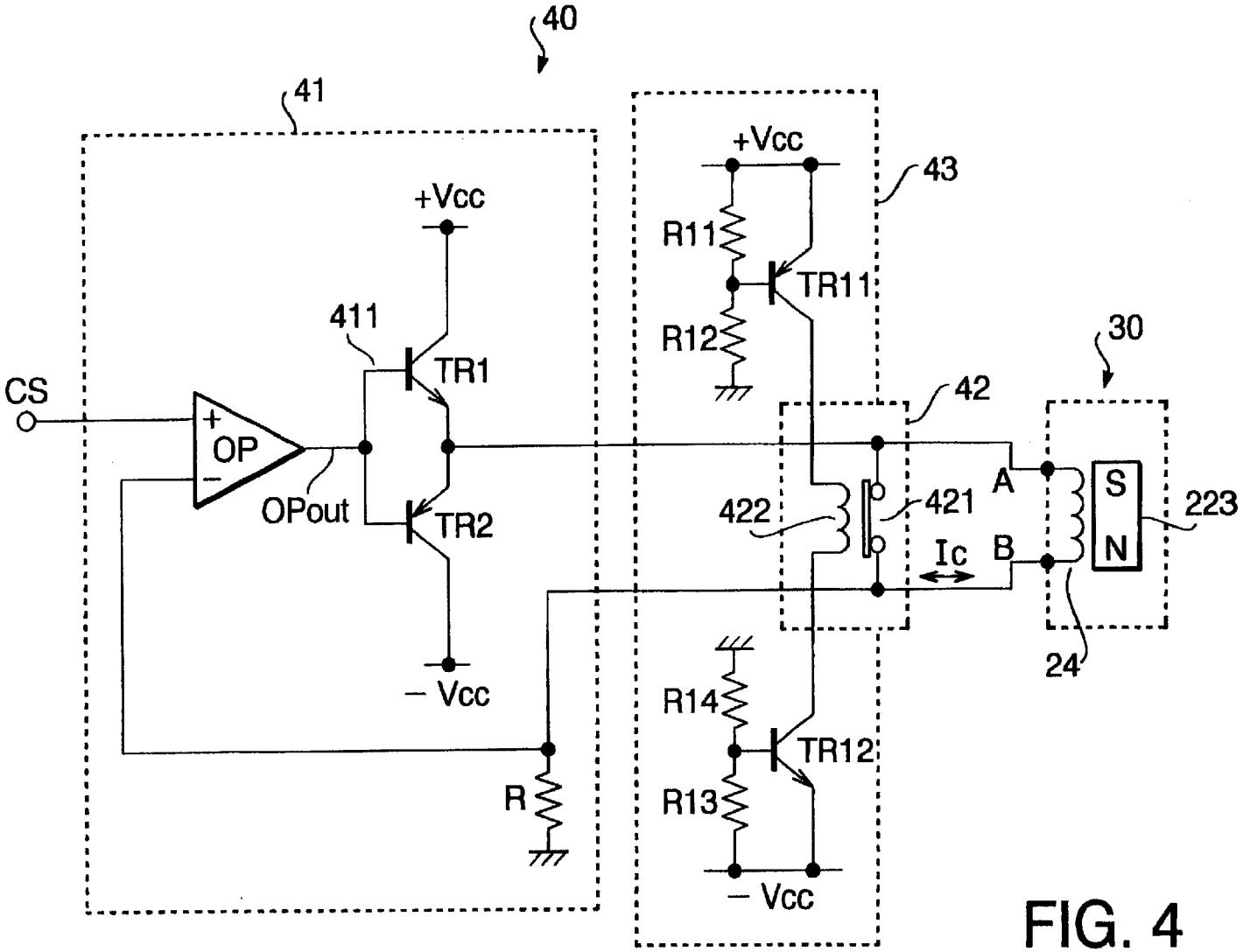
FIG. 4 is a circuit of a control device for the electromagnetic driving device according to an embodiment of the present invention.

FIG. 4 is a circuit diagram of a drive control circuit 40 for the electromagnetic driving device 30 according to an embodiment of the present invention. The drive control circuit 40 employs two power sources.

A drive control signal CS is transmitted from an external device. The drive control circuit 40 includes a drive circuit 41, a bypass unit 42 and a voltage detection circuit 43. The drive circuit 41 outputs an electrical current to the drive coil 24 in accordance with the drive control signal CS. The bypass unit 42 allows the electrical current output by the drive circuit 41 to flow through the coil 24, or bypasses the electrical current so as not to flow through the coil 24. The voltage detection circuit 43 detects voltages of a positive voltage source +Vcc and a negative voltage source −Vcc, which are the power sources of the drive circuit 41, and controls the bypass unit 42 in accordance with the detected voltages.

The operation of the drive circuit 41 will be described in detail hereinafter. The drive circuit 41 has an operational amplifier OP, a resistor R, and a current buffer circuit 411 including an NPN transistor TR1 and a PNP transistor TR2. The resistor R is serially connected between the inverted input terminal of the operational amplifier OP and the ground. The control signal CS is input to the non-inverted input terminal of the operational amplifier OP. A point, where the resistor R and the inverted input terminal of the operational amplifier OP are connected, is connected, via the bypass unit 42, to a terminal (terminal B) of the drive coil 24. The current buffer circuit 411 is configured such that the bases of the transistors TR1 and TR2 are directly connected, the emitters of the transistors TR1 and TR2 are directly connected, the output OPout of the operational amplifier OP is input to the bases of the transistors TR1 and TR2, and the emitters of the transistors TR1 and TR2 are connected, via the bypass unit 42, to the other terminal (terminal A) of the drive coil 24. The collector of the NPN transistor TR1 is connected to the positive voltage source +Vcc, and the collector of the PNP transistor TR2 is connected to the negative voltage source −Vcc.

The bypass unit 42 includes an electromagnetic relay which normally turned ON. Specifically, the bypass unit 42 includes a contact switch 421 provided between the terminals A and B of the drive coil 24, and a magnet coil 422 for turning ON/OFF the contact switch 421. When the electrical current does not flow through the magnet coil 422 (i.e., in a neutral state), the contact switch 421 is closed (i.e., connects the terminals A and B). When the electrical current flows through the magnet coil 422, the contact switch 421 is opens, i.e., the contact switch 421 does not connect the terminals A and B.

The voltage detection circuit 43 includes a positive side transistor TR11 which is a PNP transistor connected between one terminal of the magnet coil 422 and the positive power source +Vcc, and a negative side transistor TR12 which is an NPN transistor connected between the other terminal of the magnet coil 422 and the negative power source −Vcc.

The emitter of the positive side transistor TR11 is connected to the positive power source +Vcc, the collector is connected to one terminal of the magnet coil 422, and the base is connected to a connection point of dividing resistors R11 and R12, which divide a voltage difference between the positive power source +Vcc and the ground level. With this configuration, when the positive power source +Vcc reaches a predetermined voltage or more, and the base voltage reaches a threshold voltage of the positive side transistor TR11 or more, the positive side transistor TR11 is turned ON.

The emitter of the negative side transistor TR12 is connected to the negative power source −Vcc, the collector is connected to the other terminal of the magnet coil 422, and the base is connected to a connection point of dividing resistors R13 and R14, which divide a voltage difference between the negative power source −Vcc and the ground level. With this configuration, when the absolute value of the negative power source −Vcc reaches a predetermined voltage or more, and the absolute value of the base voltage reaches a threshold voltage of the negative side transistor TR12 or more, the negative side transistor TR12 is turned ON.

FIGS. 5A–5E show a timing chart illustrating an operation of the circuit shown in FIG. 4. According to the embodiment, the positive and negative voltages sources are turned ON/OFF in response to the operation of a power switch. It is assumed that the initial voltages of the positive and negative voltage sources are turned OFF, i.e., the voltages +Vcc and −Vcc are both 0V, and that the voltage of the control signal CS is also 0V. In this condition, the transistors TR11 and TR12 are both in OFF condition, and no electrical current flows through the magnet coil 422. Accordingly, the contact switch 421 is closed and the terminals A and B are short-circuited.

Figures 5A, 5B, 5C, 5D, 5E:
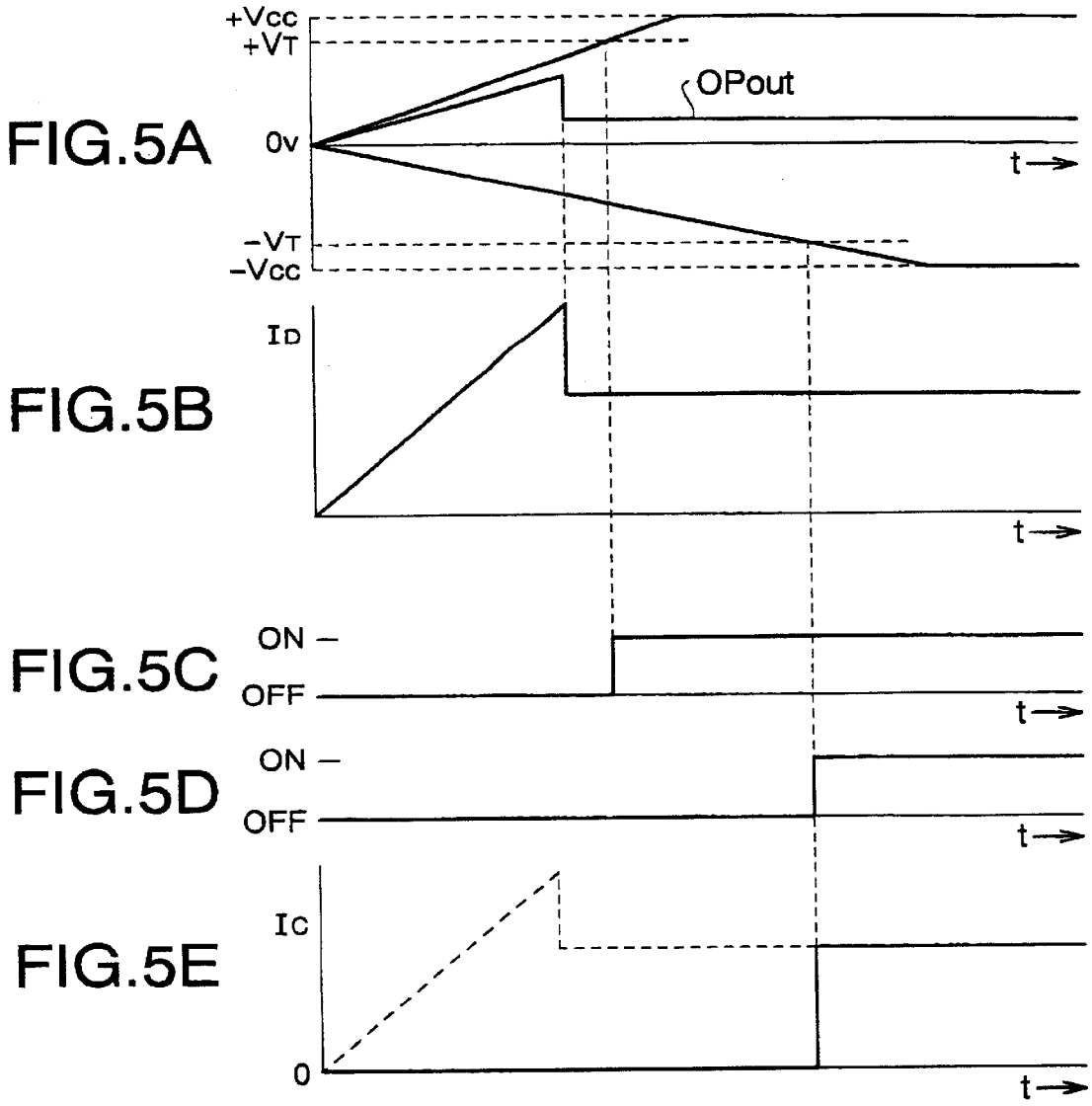
FIGS. 5A–5E show timing charts illustrating an operation of the circuit shown in FIG. 4.

When the positive and negative voltage sources +Vcc and −Vcc are turned ON, the positive voltage +Vcc increases and the negative voltage −Vcc decreases as shown in FIG. 5A. It is assumed that the increasing ratio of the positive voltage +Vcc and the decreasing ratio of the negative voltage −Vcc are different as shown in FIG. 5A. In the example shown in FIG. 5A, the decreasing ratio of the negative voltage −Vcc is smaller.

If the control signal CS or the output of the operational amplifier OP is not controlled, an abnormal voltage is output as the output voltage OPout of the operational amplifier OP. Then, as shown in FIG. 5B, a relatively large current is output from the positive voltage source +Vcc to the NPN transistor TR1, which is output from the buffer circuit 411.

When the voltage of the positive voltage source +Vcc reaches the threshold value VT, as shown in FIGS. 5A and 5C, the positive side transistor TR11 is turned ON. At this stage, however, the voltage of the negative voltage source −Vcc has not reached the threshold value −VT, and the negative side transistor TR12 remains in OFF condition. Accordingly, an electrical current does not flow through the magnet coil 422, and the contact switch 421 remains closed. Thus, the terminals A and B are shorted, and the drive coil 24 is protected from an overcurrent output from the drive circuit 41.

Thereafter, when the negative voltage −Vcc has reached the threshold value −VT as shown in FIG. 5A, the negative side transistor TR12 is turned ON as shown in FIG. 5D. Then, through the positive side transistor TR11 and the negative side transistor TR12, the electrical current flows from the positive voltage source +Vcc to the negative voltage source −Vcc. The electrical current flows through the magnet coil 422 and actuate the same. Then, the contact switch 421 of the bypass unit 42 opens, and accordingly, the electrical current output by the drive circuit 41 flows from the terminal A to the terminal B through the drive coil 24, and is grounded through the resistor R. At this stage, the control signal CS and the output of the operational amplifier OP have been stabilized, and the overcurrent condition has been resolved. Therefore, the overcurrent does not flow through the drive coil 24.

It should be noted that, when the decreasing ratio of the negative voltage source −Vcc is greater than the increasing ratio of the positive voltage source +Vcc, the similar control is performed, and the coil 24 is protected from the overcurrent.

Thus, in the optical axis adjusting device 103 described above, a magnetic force is generated by the drive coil 24, which swings about the swing axis 25, thereby inclining the prism 26 to shift the optical axis LO, or the chief ray of the laser beam LB.

The shifting amount of the optical axis LO depends on the electrical current flowing through the drive coil 24, which depends on the output of the drive circuit 41. The output of the drive circuit 41 depends on the control signal CS. Accordingly, by adjusting the voltage of the control signal CS, the position of the chief ray of the laser beam LB can be adjusted.

As described above, when the voltage sources are turned ON, even if one of the positive voltage source and the negative voltage source reaches a predetermined voltage value earlier than the other and the drive circuit outputs the overcurrent, the voltage detection circuit 43 and the bypass unit 42 protects the drive coil from the overcurrent unit until both of the positive and negative voltage sources reach respective threshold values. Therefore, the drive coil 24 is protected from being electrically and/or mechanically damaged.

Further, when the voltages sources are turned OFF, the terminals A and B are short-circuited, and the drive coil 24 forms a closed circuit. In this condition, if an oscillation or shock is applied and the drive coil 24 is moved, a counter electromotive force is generated since the coil 24 moves within the magnetic field of the magnets 223. As well-known in the art, the counter electromotive force generated as above functions to prevent the movement of the drive coil 24 due to the oscillation of the shock externally applied. Accordingly, with the above-described configuration, the drive coil 24 is protected from the external oscillation or the like when the voltage sources are turned OFF.

Figure 6:
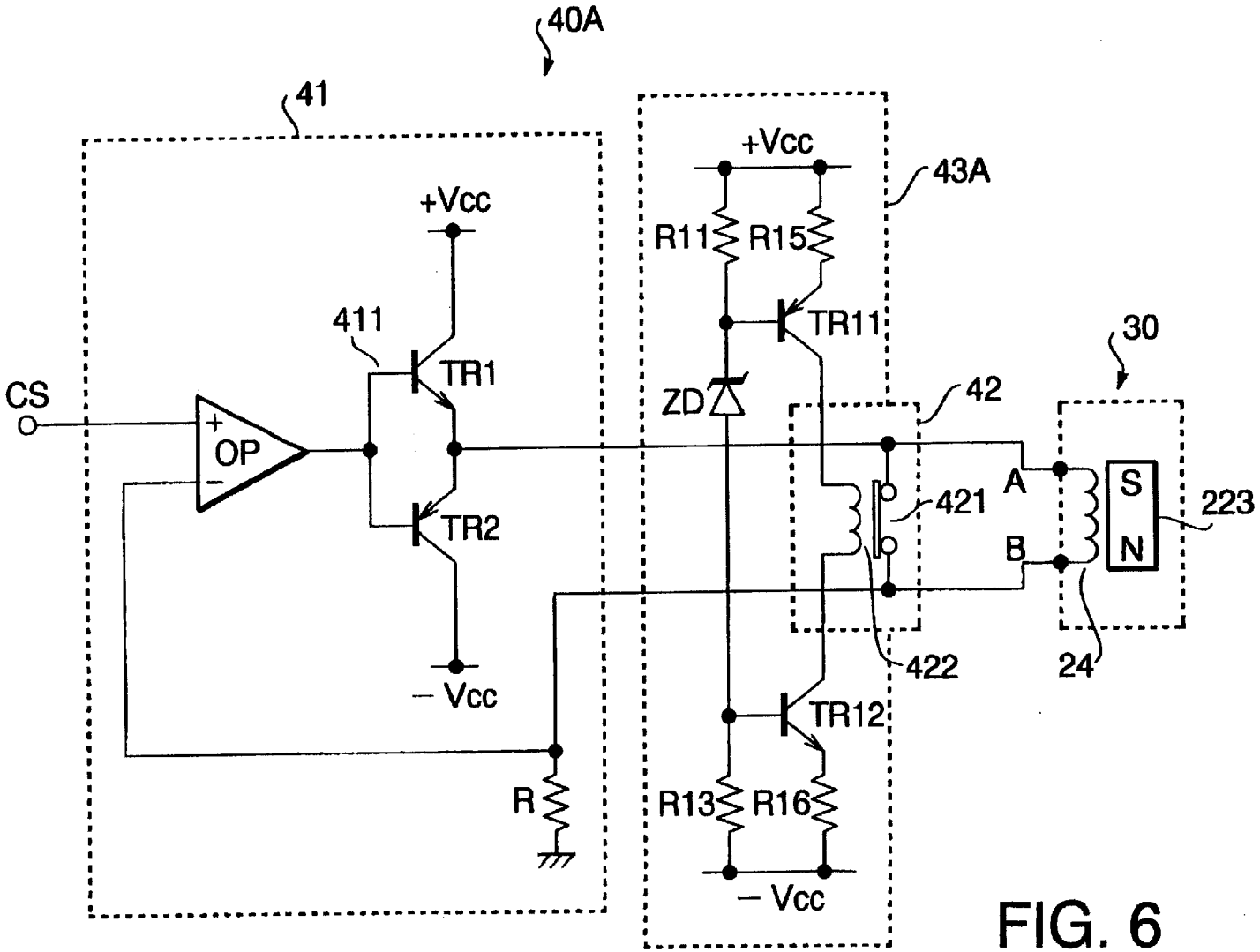
FIG. 6 is a modified circuit of the control device for the electromagnetic driving device.

FIG. 6 is a drive control circuit 40A according to a modification of the embodiment. In this modification, the voltage detection circuit 43 of the above-described embodiment has been changed to a modified voltage detection circuit 43A. The same reference numerals are given to elements having the similar function to those employed in the above-identified embodiment, and description thereof will not be repeated.

As understood from FIG. 6, the resistors R12 and R14 shown in FIG. 4 are omitted, and instead, a Zener diode ZD is connected, in a forward direction, between the bases of the transistors TR11 and TR12. Further, a resistor R15 is provided between the emitter and the positive voltage source +Vcc, and a resistor R16 is provided between the emitter and the negative voltage source −Vcc. It should be noted that the Zener diode ZD has a characteristic such that the breakdown voltage ZV thereof is substantially the same as a difference ΔVT of the positive voltage +Vcc and the negative voltage −Vcc when both of them reach predetermined values, respectively (i.e., the sum of the absolute values of the positive and negative voltages).

FIGS. 7A–7E show timing charts illustrating an operation of the modified circuit shown in FIG. 6.

Figures 7A, 7B, 7C, 7D, 7E:
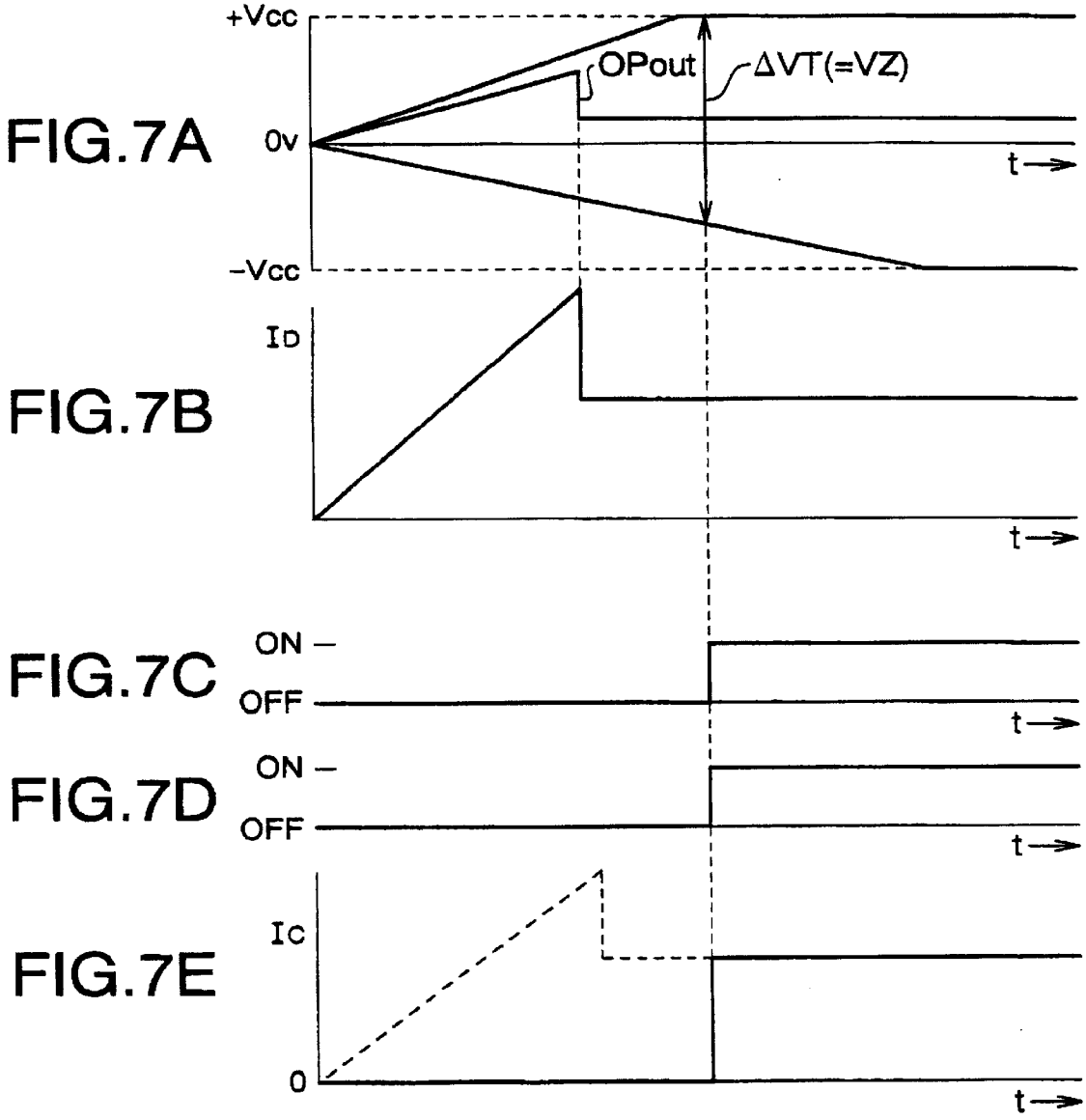
FIGS. 7A–7E show timing charts illustrating an operation of the modified circuit shown in FIG. 6.

As shown in FIG. 7A, if one of the positive voltage source +Vcc and the negative voltage source −Vcc reaches the predetermined voltage earlier than the other, only when both of the voltage sources reach the predetermined values, respectively, and the difference ΔVT between the voltage sources exceeds the breakdown voltage ZV of the Zener diode ZD, will the electrical current flow through the magnetic coil, and the contact switch 421 is opened.

As shown in FIG. 7B, the overcurrent is output by the drive circuit 41 when the voltages sources are turned ON occurs when the rising operation of one of the transistors of the current buffer circuit 411 is excessively delayed with respect to the rising operation of the other transistor. If rising condition of the both transistors has proceeded in some extent, the overcurrent has disappeared. Further, in an actual circuit, the rising condition of the ON operation of the transistors are substantially the same, a n d the difference will not be so large. Therefore, even when the contact switch 421 is opened based on the difference ΔVT of the positive voltage source +Vcc and the negative voltage source −Vcc as shown in FIGS. 7C and 7D, the overcurrent will not flow through the drive coil 24. Furthermore, according to the above-described modification, it is not necessary to keep the drive coil 24 short-circuited until the slower voltage source reaches the predetermined voltage. Therefore, the electromagnetic driving device 30 can be controlled rapidly.

In the above-described modification, until the difference between the positive voltage +Vcc and the negative voltage −Vcc reaches the predetermined value, the drive coil 24 is short-circuited by the bypass unit 42. Therefore, the drive coil 24 is in the short-break condition, and the mechanical damage can be prevented.

It should be noted that the transistors TR1, TR2, TR11, and TR12 are not limited to bi-polar transistors, but can be field effect transistors. The bypass circuit 42 is not limited to one employing an electromagnetic relay, but can also be an electronic switch whose ON/OFF condition can be switched by an electrical current flowing therethrough, for example.

Figure 8:
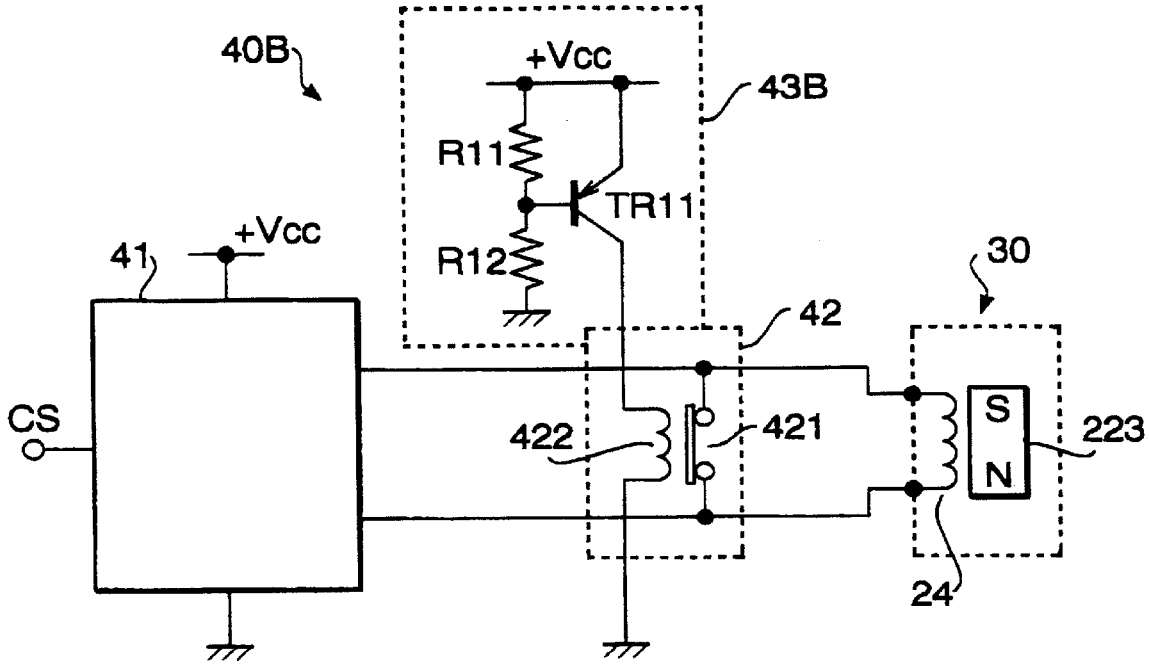
FIG. 8 is another modified circuit of the control device for the electromagnetic driving device.
Figure 9:
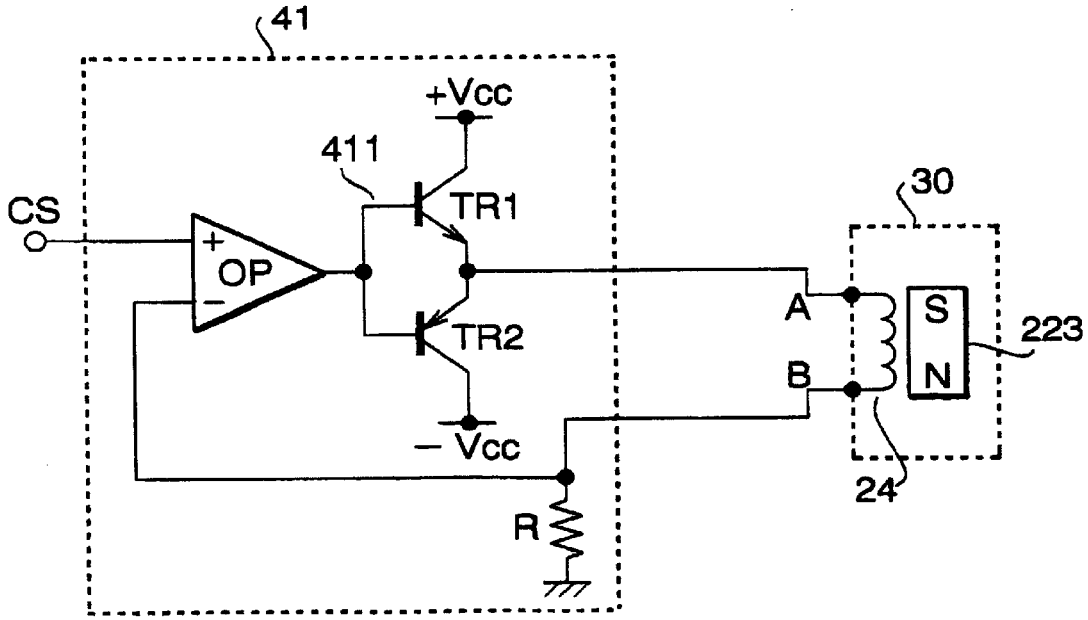
FIG. 9 PRIOR ART
FIG. 9 shows a conventional circuit of the control device of the electromagnetic driving device.

In the above-described embodiment and modification, two voltage sources are employed. However, the present invention is not limited to the application of such systems, but can be applicable to an electromagnetic driving device employing a single voltage source. FIG. 8 shows a circuit diagram illustrating an example of such a circuit employing a single voltage source.

As shown in FIG. 8, the circuit includes a voltage detection circuit 43B, which includes a transistor TR11, resistors R11 and R12 connected in series. The base of the transistor TR11 is connected to a point where the transistor TR11 and TR12 are connected. The resistor R12 is grounded, and the resistor R11 is connected to the voltage source +Vcc, to which the collector of the transistor TR11 is also connected.

When the voltage source +Vcc is turned ON, until the voltage reaches a predetermined voltage +VT, the transistor TR11 remains in an OFF condition. Accordingly, an electrical current does not flow through the magnet coil 422, and the contact switch 421 is closed to short-circuit the drive coil 24. During this period, an overcurrent may be generated due to a surge voltage or the like. Since the drive coil 24 is short-circuited, it is protected from an electrical damage.

When the voltage +Vcc increases and has reached the predetermined voltage +VT, the transistor TR11 is turned ON, thereby the magnetic coil 422 is actuated to open the contact switch 421. Then, the output of the drive circuit 41 is applied to the drive coil 24 to drive the electromagnetic driving device 30. Similarly to the above-described embodiment and modification, when the voltage source is turned OFF, the contact switch 421 is closed to connect the both ends of the drive coil 24, it is protected from a mechanical damage even if the electromagnetic device 30 is oscillated by an external force.

As described above, according to the invention, the drive coil is protected from the overcurrent when a voltage source or voltage sources are turned ON and the voltage thereof is increasing. Further, when the voltage sources are turned OFF, a short-break is applied and the electromagnetic driving device is prevented from mechanical damages.

The present disclosure relates to the subject matter contained in Japanese Patent Application No. 2000-379803, filed on Dec. 14, 2000, which is expressly incorporated herein by reference in its entirety.

What is claimed is:

1. A drive control circuit for an electromagnetic driving device including a magnet and a drive coil that moves due to an electromagnetic force, when an electrical current flows therethrough, said drive control circuit comprising:

a drive circuit that feeds an electrical current to the drive coil, said drive circuit including at least one voltage source;

a short-circuit system that short-circuits said drive coil, said short-circuit system releasing the short-circuited condition of said drive coil in accordance with an output voltage of said at least one voltage source.

2. The drive control circuit according to claim 1, wherein said short-circuit system includes a voltage detection circuit that detects the output voltage of said at least one voltage source.

3. The drive control circuit according to claim 2, wherein said short-circuit system includes an electromagnetic relay system including:

a magnet coil actuated in accordance with an output of said voltage detection circuit;

a contact switch provided between both end terminals of said drive coil, said contact switch neutrally connecting said both end terminals of said drive coil, said contact switch disconnecting said both end terminals of said drive coil when said magnet coil is actuated.

4. The drive control circuit according to claim 3, wherein said voltage detection circuit includes a switching circuit connected between said at least one voltage source and said magnet coil, said switching circuit being turned ON to connect said at least one voltage source and said magnetic coil when the output of said voltage source has satisfied a predetermined condition.

5. The drive control circuit according to claim 1, wherein said drive circuit has an input terminal to which a control signal is input, said drive circuit outputting an electrical current to said drive coil through said short-circuit system.

6. The drive control circuit according to claim 1, wherein said at least one voltage source includes a positive voltage source and a negative voltage source, wherein said short-circuit system includes a first voltage detection circuit that detects the output voltage of said positive voltage source and a second voltage detection circuit that detects the output voltage of said negative voltage source, and wherein said short-circuit system maintains or releases the short-circuited condition of said drive coil in accordance with the output voltages of said positive and negative voltage sources.

7. The drive control circuit according to claim 6, wherein said short-circuit system releases the short-circuited condition of said drive coil when the absolute values of the output voltages of said positive and negative voltage sources exceed predetermined values, respectively.

8. The drive control circuit according to claim 7, wherein said short-circuit system includes an electromagnetic relay system having:

a magnet coil;

a contact switch provided between both end terminals of said drive coil, said contact switch neutrally connecting said both end terminals of said drive coil, said contact switch disconnecting said both end terminals of said drive coil when said magnet coil is actuated;

wherein said voltage detection circuit includes a first switching circuit connected between said positive voltage source and the one end of said magnet coil and a second switching circuit connected between said negative voltage source and the other end of said magnet coil, said first and second switching circuits being turned ON when the absolute values of the output voltages of said positive and negative voltage sources exceed the predetermined values, respectively.

9. The drive control circuit according to claim 6, wherein said short-circuit system releases the short-circuited condition of said drive coil when a difference between the output voltages of said positive and negative voltage sources exceeds a predetermined value.

10. The drive control circuit according to claim 9, wherein said short-circuit system includes an electromagnetic relay system having:

a magnet coil;

a contact switch provided between both end terminals of said drive coil, said contact switch neutrally connecting said both end terminals of said drive coil, said contact switch disconnecting said both end terminals of said drive coil when said magnet coil is actuated;

wherein said voltage detection circuit includes a first switching circuit connected between said positive voltage source and the one end of said magnet coil and a second switching circuit connected between said negative voltage source and the other end of said magnet coil, said first and second switching circuits being turned ON when the difference between the output voltages of said positive and negative voltage sources exceeds said predetermined value.

11. The drive control circuit according to claim 1, wherein said at least one voltage source includes a single voltage source, wherein said short-circuit system includes a single voltage detection circuit that detects the output voltage of said positive voltage source, and wherein said short-circuit system maintains or releases the short-circuited condition of said drive coil in accordance with the output voltages of said positive and negative voltage sources.

12. The drive control circuit according to claim 11, wherein said short-circuit system releases the short-circuited condition of said drive coil when the output voltages of said single voltage sources exceed a predetermined value.

13. The drive control circuit according to claim 12, wherein said short-circuit system includes an electromagnetic relay system having:

a magnet coil;

a contact switch provided between both end terminals of said drive coil, said contact switch neutrally connecting said both end terminals of said drive coil, said contact switch disconnecting said both end terminals of said drive coil when said magnet coil is actuated, and wherein said voltage detection circuit includes a single switching circuit connected between said single voltage source and one end of said magnet coil, said switching circuit being turned ON when the output voltages of said single voltage sources exceeds the predetermined value.

* * * * *